US005221555A

United States Patent [19]

Saverin et al.

[11] Patent Number: 5,221,555

[45] Date of Patent: Jun. 22, 1993

[54] REVERSE SIDE COATING OF PHOTOGRAPHIC SUPPORT MATERIALS

[75] Inventors: Eckehard Saverin, Osnabruck; Hans-Udo Tyrakowski, Hasbergen, both of Fed. Rep. of Germany

[73] Assignee: Felix Schoeller Jr. GmbH & Co. KG, Osnabruck, Fed. Rep. of Germany

[21] Appl. No.: 806,158

[22] Filed: Dec. 12, 1991

[51] Int. Cl.[5] ..... B05D 1/00

[52] U.S. Cl. ..... 427/209; 427/385.5

[58] Field of Search ..... 427/209, 385.5

[56] References Cited

FOREIGN PATENT DOCUMENTS

| | | |
|---|---|---|
| 0250154A2 | 12/1987 | European Pat. Off. . |
| 0274017 | 7/1988 | European Pat. Off. . |
| 0300376A1 | 1/1989 | European Pat. Off. . |
| 0312638A1 | 4/1989 | European Pat. Off. . |
| 1597555 | 5/1970 | Fed. Rep. of Germany . |
| 2312674 | 9/1973 | Fed. Rep. of Germany . |
| 1745061 | 10/1974 | Fed. Rep. of Germany . |
| 1669178B2 | 9/1976 | Fed. Rep. of Germany . |
| 1943114B2 | 8/1978 | Fed. Rep. of Germany . |
| 3114627A1 | 2/1982 | Fed. Rep. of Germany . |
| 3713495A1 | 11/1988 | Fed. Rep. of Germany . |
| 3731733A1 | 4/1989 | Fed. Rep. of Germany . |
| 3712206C2 | 5/1990 | Fed. Rep. of Germany . |

*Primary Examiner*—Bernard Pianalto

*Attorney, Agent, or Firm*—Lockwood, Alex, FitzGibbon & Cummings

[57] ABSTRACT

A photographic support material comprising a plastic foil or plastic coated paper coated on the rear side with a composition that can be printed with thermal printers and does not pick up dirt or discoloration in developing baths, has good adhesive tape adhesion, good printability with conventional printers, good abrasion resistance and bath resistance, and a good antistatic finish. The coating composition comprises an aqueous mixture of colloidal aluminum modified silica, a polyfunctional aziridine, an alkali salt of an organic polyacid, and a plastic dispersion with free carboxyl groups, a residual monomer content of <200 ppm, >50 mol % rigid monomers in the polymer and the interfacial tension of the dried film of >50 dyn/cm.

11 Claims, No Drawings

REVERSE SIDE COATING OF PHOTOGRAPHIC SUPPORT MATERIALS

BACKGROUND AND DESCRIPTION OF THE INVENTION

This invention concerns a coating composition for the rear side of photographic support materials for light-sensitive layer and a process for producing same. The support material may be a plastic coated paper or a plastic foil. The rear side is the surface of the supports material opposite the front side which will later carry the image.

Plastic foils or papers coated on their surfaces, i.e. the front side and rear side, with polyolefin layers are usually used as support materials for photosensitive layers, especially for color photography. These polyolefin coatings are preferably applied by melt extrusion methods using polyolefin. Such a photographic support materials are described, for example, in U.S. Pat. No. 3,411,908.

The polyolefins may be polyethylenes, such as LDPE, LLDPE, HDPE or polypropylene or mixtures of these components. They have many advantages as layer forming substances, but they also have properties that are a disadvantage within the context of producing or further handling of such papers. Apart from the adhesion problems between the polyolefin surface and the light-sensitive emulsion which can be eliminated by additional measures and means, polyolefin layers must fulfill certain properties in the course of production and processing of such photographic papers or, in some cases, certain properties of the polyolefins must be suppressed or overcome.

Thus, for example, it is necessary to be able to label the photographic materials that are to be developed by writing or printing on the rear side of the support material so the materials can be identified as belonging to certain customers and clients. A hydrophobic polyolefin coating that seals the paper core, however, permits writing or labeling only to a limited extent. Special measures and means are required in order to assure general printability or writability in machine processing of the photographic material.

It is also necessary for the photographic material coated with light sensitive emulsions not to attract dirt particles to its surface ("tar stain") in the various treatment baths. These stains develop over a period of time due to oxidation and condensation processes in old photographic treatment baths.

In addition to such partial reception of dirt particles at the surface (tar stain) there can also be absorption of developer solution on the full area of the support material to such an extent that it is no longer completely reversible during the further passage through the treatment baths. This absorbed developer or the absorbed developer components oxidize in air and lead to more or less intense yellow discoloration of the full surface area.

In addition, it is necessary to prevent the developer solutions or baths from becoming contaminated by the agents that are responsible for printability, writability and similar desirable properties. This means that the layer on the rear side (backing layer) must be abrasion resistant and bath resistant.

Another requirement for such photographic support materials is good adhesion for adhesive tape which is used to secure the rolls of photographic paper strips to each other. The tape connections must not become detached when passed through the aqueous bath liquids in the developing process.

Finally, electrostatic charge buildup by the support materials should also be prevented in order to prevent flash exposure as the plastic coated photographic support material or plastic foil is passed through the emulsion coating machine or through the developing machines. Such flash exposure would lead to the non-usability of the light-sensitive emulsions or could destroy the latent image that is developing.

A new requirement that has been added is printability with thermal printers. Thermal printers transfer printing inks within a sheet period of time at high temperatures.

In summary, a backing layer should impart the properties of writability, printability, adhesive tape adhesion, abrasion resistance, antistatic properties and thermal printability to the support materials for light-sensitive layers, but should not contaminate the photographic treatment baths, should not allow reception of dirt due to tar-like oxidation products from the photographic developers, and should not allow discoloration of the surface due to oxidized developer components.

It is known that the requirements of a rear backing layer described here necessitates different measures, and in the past it has been difficult to achieve these requirements on the whole because the measures and means presented to solve them were often contradictory.

For example, it is known from European laid open publication No. 0 160 912 that the rear side of a polyethylene coated photographic material can be provided with an antistatic layer consisting of a sodium magnesium silicate, a sodium polystyrene sulfonate and certain succinic acid semiesters. This layer should prevent a buildup of electrostatic charge and should also protect the material from dirt. However, this layer does not permit good adhesion of adhesive tape, has a low bath resistance and unsatisfactory thermal printability.

DE-OS 3 700 183 discloses a photographic support material with a backing layer that is a useful compromise between different good properties. It has good antistatic properties, good printability, moderate to good abrasion resistance and bath resistance, low to moderate dirt reception and good adhesive tape adhesion. However, the dirt reception (tar stain) in various other oxidized photographic developers is too great, and the thermal printability is unsatisfactory.

EP-OS 312 638 describes a photographic support material for light-sensitive layers with a similar backing layer as that in DE-OS 3 700 183. It yields good results in antistatic properties, adhesive tape adhesion, printability, abrasion resistance and bath resistance, and also has minimum tar stain and discoloration of the surface due to oxidized developer components. In addition, it can be written on well with a pencil. However, this backing layer is poor with regard to thermal printability.

All the solutions described here, however, have proven to be inadequate in recent times because due to a constant increase in the use of developer capacities, the pot life (changing cycle) of photographic baths has become longer, and tar-like and strongly colored oxidation products are formed to an increasing extent in the photographic developing baths. Consequently, higher and higher demands are made of the photographic support materials, especially with regard to tar stain and surface discoloration.

Another requirement regarding the rear side of photographic support materials is that it must be printable with thermal printers where a printing ink is transferred within a short period of time at a high temperature.

Therefore, the object of this invention is to make available coating compositions for backing layers of support materials for light-sensitive layers that also have significantly reduced soiling due to tar-like oxidation products from the photographic developer bath (tar stain) after passing through extremely aged photographic treatment baths, definitely lower discoloration due to oxidizing developer components absorbed at the surface than in the current state of the art, and they must be printable with thermal printers. A basic condition here is that the layer must not be at all inferior to the state of the art with regard to the other properties described above.

This object is solved by an aqueous coating composition containing the following components:

a colloidal aluminum modified silica, an alkali salt of an organic polyacid, a polyfunctional aziridine, and a plastic dispersion that has a residual monomer content of <200 ppm, >50 mol % rigid monomers in the polymer, free carboxyl groups in the polymer, and an interfacial tension of >50 dyn/cm as the dried film.

However, this basic formulation can be supplemented by additional additives in order to reinforce existing properties or create other properties. Such additives may include a silica with a particle size of >2 μm, optical brighteners, nuancing dyes, delustering agents of an organic or inorganic type, white pigments, wetting agents, etc. For example, adding silica with a particle size of >2 μm makes the layer more suitable for accepting pencil writing.

The individual components in the aqueous coating composition are present in the following amounts:

| | |
|---|---|
| plastic dispersion (as a 50 wt % aqueous dispersion) | 3.0–7.0 wt % |
| aluminum modified colloidal silica (as a 30 wt % aqueous dispersion) | 2.5–9.0 wt % |
| alkali salt of an organic polyacid (as a 30 wt % aqueous dispersion) | 0.5–4.0 wt % |
| polyfunctional aziridine (as a 50 wt % alcoholic solution) | 0.2–1.5 wt % |
| with the remainder being water. | |

Then the dried layer contains approximately the following amounts:

| | |
|---|---|
| polymer | 30–70 wt % |
| aluminum modified silica | 16–64 wt % |
| alkali salt of an organic polyacid | 3–25 wt % |
| polyfunctional aziridine | 2–16 wt % |

The polymer of the plastic dispersion is thus composed of one or more of the monomers styrene, butadiene, acrylic ester, methacrylate ester, vinyl acetate, vinyl chloride, maleic ester, olefin or acrylonitrile combined with monomers with free carboxyl groups. These monomers with free carboxyl groups may include, for example, maleic acid, acrylic acid and methacrylic acid, crotonic acid, itaconic acid, vinyl acetic acid, etc.

A copolymer of the aforementioned monomers is preferred. There should be >50 mol % rigid components such as styrene, methacrylate ester, acrylate ester, vinyl chloride or vinyl acetate in the copolymer. These are components or monomers which in the form of homopolymers have a ball indentation hardness of >1000 kg/cm$^2$. The copolymer must have a low free carboxyl group content for the crosslinking reaction with polyfunctional aziridines. This amount should be preferably 1–5 mol%. The residual monomer content should be <200 ppm.

It has surprisingly been found that coating compositions with selected plastic dispersions having an interfacial tension of >50 dyn/cm as the dried film meet all the required properties, whereas coating compositions with plastic dispersions that have an interfacial tension of <50 dyn/cm as the dried film yield unsatisfactory results.

The aluminum modified silica in the coating composition has, as a colloidal solution, a particle size of 7–16 nm and the modification depends preferably on exchanging a few silicon atoms for aluminum atoms.

The alkali salt of an organic polyacid may be a lithium salt, a sodium salt or a potassium salt of polyacrylic acid or polymethacrylic acid, maleic acid, itaconic acid, crotonic acid, polysulfonic acid or copolymers of these compounds as well as cellulose derivatives. The alkali salts of polystyrene sulfonic acid or naphthalene sulfonic acid or an alkali cellulose sulfate are preferred.

Of the polyfunctional aziridines, trifunctional aziridines of the following general formula are especially preferred:

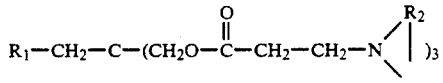

where $R_1$ is —$CH_3$ or —OH and $R_2$ is —$CH_3$ or —OH.

All conventional applicator systems are suitable for applying the coating compositions. The surface of the photographic support material to be coated in this way is preferably pretreated by corona discharge in order to achieve better adhesion of the applied layer.

The following examples are presented to illustrate this invention in greater detail but do not restrict in any way.

EXAMPLE 1

A support material consisting of a highly sized base paper with a basis weight of 175 g/m$^2$ and 30 g/m$^2$ polyethylene with 11 wt % titanium dioxide on the front side and 35 g/m$^2$ polyethylene on the rear side was coated on the rear side with the coating compositions listed in Table 1.

After surface treatment of the support material by means of corona discharge, the coating compositions were applied with a roll coater system to the surface to be coated, metered with a smoothing doctor and dried in a hot air channel at air temperatures of about 90° C. The working speed was 100 m/min. The weight of the dried layer was 0.4 g/m$^2$±0.2 g/m$^2$.

TABLE 1

Coating Compositions According to Example 1, wt %

| EXAMPLE | 1a | 1b | 1c | 1d | 1e | 1f |
|---|---|---|---|---|---|---|
| Colloidal modified silica, 30 wt % in water (Ludox AM)* | 6.0 | 4.0 | 3.0 | 8.0 | 5.0 | 6.0 |

TABLE 1-continued

| Coating Compositions According to Example 1, wt % | | | | | | |
|---|---|---|---|---|---|---|
| Sodium polystyrene sulfonate, 30 wt % in water | 1.8 | — | — | 0.6 | 1.6 | 1.0 |
| Sodium naphthalene trisulfonate, 30 wt % in water | — | 3.5 | — | — | — | — |
| Sodium cellulose sulfate, 10 wt % in water | — | — | 3.0 | — | — | — |
| Styrene-butadiene copolymer 1*, 50 wt % dispersin in water | 6.0 | 5.0 | 4.0 | — | — | — |
| Styrene-butadiene copolymer 2*, 48 wt % dispersion in water | — | — | — | 7.0 | 5.0 | — |
| Styrene-butyl acrylate copolymer 3*, 42 wt % dispersion in water | — | — | — | — | — | 6.0 |
| Silica (particle size 3-6 μm), 10 wt % in water | — | — | 5.0 | — | 5.0 | — |
| Trifunctional aziridine, 50 wt % in IPA (Xama 7)* | 0.6 | 0.7 | 0.3 | 1.3 | 0.7 | 0.9 |
| Wetting agent, 10 wt % in water/methanol = 1:1 | 1.0 | 1.0 | 1.0 | 1.0 | 1.0 | 1.0 |
| Demineralized water | 84.6 | 85.8 | 83.7 | 82.1 | 81.7 | 85.1 |

| | Copolymer 1 | Copolymer 2 | Copolymer 3 |
|---|---|---|---|
| Styrene-butadiene ratio | 68:32 | 55:45 | — |
| Styrene-butyl acrylate ratio | — | — | 55:45 |
| Carboxyl group content in th copolymer (mol %) | ca. 2 | ca. 1 | ca. 3 |
| Interfacial tension of the dried film | >56 dyn/cm | 52 dyn/cm | 55 dyn/cm |
| Residual monomer content (ppm) | 100-200 | 100-200 | ca. 12 |

*Ludox AM = product of E.I. Du Pont de Nemours & Co.
*Xama 7 = product of Celanese Virginia Chemicals
*Copolymer (as a plastic dispersion):

The interfacial tension is determined by applying test solutions with a known surface tension to the layer to be tested. The value of the test solution with the highest surface tension wetting the full area of the layer to be tested for at least 2 seconds is given as the interfacial tension in dyn/cm.

The finished samples were subjected to the following tests:

Surface resistively

The antistatic properties were tested by measuring the surface resistively with an electrode according to DIN 53,482.

Adhesive tape adhesion

A commercial adhesive tape such as 3M adhesive tape 8422 was used for the adhesive test. The adhesive tape was applied to the rear side layer and weighted with a 3 kg weight. Then the sample with the adhesive tape was cut into strips 1.5 cm wide and the adhesive tape was pulled away from the sample at an angle of 180° in a breaking load tester at the rate of 20 cm/min. The force needed to pull away the tape was measured. A force of more than 2.0 kNm is considered good.

Tar stain

In the tar stain test (dirt reception) various commercial color developers from Europe, Japan and the United States were poured to a depth of about 2 cm in an open dish and left to stand in air for one week. After this period of time, a dark tar-like layer of oxidation products had formed at the surface. The sample to be tested was slightly curved when pulled over this tar-like surface layer so as to assure good contact between the sample and the tar. Then the sample was washed under running water and dried in air. The adhering stain was evaluated visually as a measure of the tar stain of the layer to be tested. If there were only isolated dirt particles visible on the surface of the sample, the behavior was "good." If there were no dirt particles on the surface, the behavior was "very good."

Discoloration

The discoloration of the backing layer by the photographic development process was evaluated visually after one pass of the sample through the automatic developer and then storing the samples for 4 days in the presence of air at room temperature.

Printability

The test of printability (print image after treatment in the bath) was performed with commercial color ribbons. The samples were printed by typing on the color ribbons. For the test the printed samples were immersed for 30 seconds in a commercial developer. Then the print was rubbed lightly with a finger and rinsed with water. Smudges or discoloration served as a visual evaluation of the printability of the samples.

Abrasion resistance and bath resistance

Printed samples (see testing of printability) were immersed for 30 seconds in a commercial developer and then rinsed with water. The abrasion resistance and bath resistance were determined by rubbing well with a finger on the printed wet surface of the sample.

TABLE 2

| | Test Results | | | | | |
|---|---|---|---|---|---|---|
| | 1a | 1b | 1c | 1d | 1e | 1f |
| Surface resistivity ($\Omega/cm^2$) | | | | | | |
| before the developing process | $7.10^8$ | $5.10^8$ | $9.10^9$ | $5.10^9$ | $3.10^9$ | $6.10^9$ |
| after the developing process | $4.10^9$ | $2.10^9$ | $8.10^{10}$ | $8.10^{10}$ | $1.10^{10}$ | $4.10^{10}$ |
| Adhesive tape adhesion (kNm) | 2.4 | 2.4 | 2.2 | 2.8 | 2.1 | 2.3 |
| Tar-stain, developer from | | | | | | |
| Europe | very good | very good | very good | very good | very good | very good |
| Japan | very good | very good | very good | very good | very good | very good |
| USA | very good | very good | very good | very good | very good | very good |
| Discoloration due to developer | very slight | very slight | very slight | very slight | very slight | very slight |
| Printability | good | good | good | good | good | good |
| Abrasion resistance and bath resistance | good | good | good | good | good | good |

TABLE 2-continued

| | Test Results | | | | | |
|---|---|---|---|---|---|---|
| | 1a | 1b | 1c | 1d | 1e | 1f |
| Printability with thermal printers | very good | good | good | very good | very good | very good |

Samples 1c and 1e could also be written on well with a pencil.

We claim:

1. A process for coating the rear side of photographic support materials, comprising preparing a coating composition by adding the following components in the order given to water while stirring continuously:

a dispersion of an aluminum modified colloidal silica;

a plastic dispersion containing a polymer and having a residual monomer content of <200 ppm, >50 mol % rigid monomers in the polymer, free carboxyl groups in the polymer, and an interfacial tension of >50 dyn/cm when dried;

an aqueous solution of an alkali salt of an organic polyacid; and a polyfunctional aziridine diluted in alcohol;

applying the coating composition to the rear side of a photographic support material after said components have been completely distributed; and drying the applied coating composition under the influence of heat.

2. The process of claim 1, wherein the free carboxyl group content in the polymer in the plastic dispersion is 1-5 mol %.

3. The process of claim 1, wherein the polymer of the plastic dispersion is selected from-the group consisting of one or more of the monomers styrene, butadiene, acrylic ester, acrylonitrile, methacrylate ester, vinyl acetate, vinyl chloride, maleic ester and olefin combined with at least one monomer with free carboxyl groups.

4. The process of claim 2, wherein the polymer of the plastic dispersion is selected from the group consisting of one or more of the monomers styrene, butadiene, acrylic ester, acrylonitrile, methacrylate ester, vinyl acetate, vinyl chloride, maleic ester and olefin combined with at least one monomer with free carboxyl groups.

5. The process of claim 1, wherein the free carboxyl groups are incorporated into the polymer by means of monomers selected from the group consisting of maleic acid, acrylic acid, methacrylic acid, crotonic acid, vinyl acetic acid and itaconic acid.

6. The process of claim 1, wherein the polymer of the plastic dispersion includes mainly rigid monomers that have a ball indentation hardness of >1000 kg/cm$^2$ in the form of the homopolymer.

7. The process of claim 1, wherein the polyfunctional aziridine is a trifunctional aziridine.

8. The process of claim 1, wherein the alkali salt of an organic polyacid is an alkali salt selected from the group consisting of polystyrene sulfonic acid, naphthalene sulfonic acid, and an alkali cellulose sulfate.

9. The process of claim 1, wherein the amounts by weights of the components of the coating composition which is applied to the material are:

about 2.5-9 wt % colloidal aluminum modified silica as a 30 wt % dispersion in water;

about 0.5-4 wt % alkali salt of an organic polyacid as a 30 wt % aqueous solution;

about 3-7 wt % plastic dispersion as a 50 wt % dispersion in water;

about 0.2-1.5 wt % polyfunctional aziridine as a 50 wt% alcoholic solution; and water remainder up to 100 wt %.

10. The process of claim 1, wherein said coating composition also includes silica with a particle size of >2 μm.

11. The process of claim 1, wherein said coating composition also includes up to 2 wt % solids of other additives selected from the group consisting of optical brighteners, white pigments, dyes, dispersants, wetting agents and antioxidants.

* * * * *

UNITED STATES PATENT AND TRADEMARK OFFICE

CERTIFICATE OF CORRECTION

PATENT NO. : 5,221,555

DATED : June 22, 1993

INVENTOR(S) : Eckehard Saverin, Hans-Udo Tyrakowski

It is certified that error appears in the above-indentified patent and that said Letters Patent is hereby corrected as shown below:

Col. 1, line 9, "layer" should read --layers--; line 11, "supports" should read --support.

Col. 5, line 13, "dispersin" should read --dispersion--.

Signed and Sealed this

Twenty-first Day of March, 1995

Bruce Lehman

*Attest:*

BRUCE LEHMAN

*Commissioner of Patents and Trademarks*

*Attesting Officer*